US007940014B2

(12) United States Patent
Shin et al.

(10) Patent No.: US 7,940,014 B2
(45) Date of Patent: May 10, 2011

(54) APPARATUS FOR DRIVING LIGHT EMITTING ELEMENT

(75) Inventors: Sang Cheol Shin, Gyunggi-Do (KR); Byoung Own Min, Gyunggi-Do (KR); Jung Chul Gong, Seoul (KR); Yu Jin Jang, Gyunggi-Do (KR); Seung Kon Kong, Gyunggi-Do (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 403 days.

(21) Appl. No.: 12/254,520

(22) Filed: Oct. 20, 2008

(65) Prior Publication Data

US 2009/0128055 A1 May 21, 2009

(30) Foreign Application Priority Data

Nov. 15, 2007 (KR) ..... 10-2007-0116777

(51) Int. Cl.
*H05B 37/02* (2006.01)

(52) U.S. Cl. ..... 315/294; 315/307; 315/185 R

(58) Field of Classification Search ..... 315/82, 315/87, 88, 102, 167, 291, 294, 107, 307, 315/308, 345, 312, 185 R
See application file for complete search history.

(56) References Cited

U.S. PATENT DOCUMENTS

| | | | | |
|---|---|---|---|---|
| 6,734,639 | B2 * | 5/2004 | Chang et al. | 315/291 |
| 6,864,641 | B2 | 3/2005 | Dygert | |
| 7,659,672 | B2 * | 2/2010 | Yang | 315/224 |
| 7,671,575 | B1 * | 3/2010 | Suzuki et al. | 323/285 |
| 7,728,530 | B2 * | 6/2010 | Wang et al. | 315/291 |
| 7,733,030 | B2 * | 6/2010 | Brokaw et al. | 315/209 R |
| 7,821,491 | B2 * | 10/2010 | Tanaka | 345/102 |
| 7,868,602 | B2 * | 1/2011 | Omi et al. | 323/284 |

FOREIGN PATENT DOCUMENTS

KR 10-2007-0015857 A 6/2007

* cited by examiner

*Primary Examiner* — Don P Le

(74) *Attorney, Agent, or Firm* — Lowe Hauptman Ham & Berner LLP

(57) ABSTRACT

Provided is an apparatus for driving a light emitting element. The apparatus includes a power unit, a light emitting element array, a constant-current circuit unit, and a voltage limiting circuit unit. The power unit supplies driving power. The light emitting element array includes a plurality of light emitting elements connected in series between an anode terminal connected to the power unit and a cathode terminal. The constant-current circuit unit maintains a constant current flowing through the light emitting element array according to a first tuning voltage. The voltage limiting circuit unit is connected between the cathode terminal of the light emitting element array and the constant-current circuit unit, and divides a total voltage applied between the cathode terminal of the light emitting element array and a ground according to a second tuning voltage to limit a voltage applied to the constant-current circuit unit below a predetermined voltage.

13 Claims, 6 Drawing Sheets

APPARATUS FOR DRIVING LIGHT EMITTING ELEMENT

CROSS-REFERENCE TO RELATED APPLICATIONS

This application claims the priority of Korean Patent Application No. 2007-116777 filed on Nov. 15, 2007, in the Korean Intellectual Property Office, the disclosure of which is incorporated herein by reference.

BACKGROUND OF THE INVENTION

1. Field of the Invention

The present invention relates to an apparatus for driving a light emitting element that can be applied to a light source or a backlight unit, and more particularly, to an apparatus for driving a light emitting element that can limit heat generation of a constant-current circuit including a metal oxide semiconductor (MOS) transistor by limiting a voltage applied to the constant-current circuit required for supplying a constant current to the light emitting element.

2. Description of the Related Art

In general, a light emitting element is an element emitting light. Examples of the light emitting element include a light emitting diode (LED), a laser diode (LD), and an organic light emitting diode (OLED).

The LED, which is one of the light emitting elements, is applied to various fields such as a lighting unit and a backlight unit, and will be applied to various fields in the future.

Two methods are used in driving the LED. One is using DC/DC of a switching mode, and the other is using a current source. Since the method of using the current source has not only a small switching noise but also a simple circuit, it is widely used. However, a heat generation from a MOS transistor included in the current source should be solved.

Hereinafter, a related art apparatus for driving an LED using a current source is described.

FIG. 1 is a view illustrating the construction of a related art apparatus for driving an LED. The apparatus for driving the LED includes a power unit 10 supplying driving power V required for driving a plurality of LEDs, which are light emitting elements, an LED unit 20 including the plurality of LEDs connected to the power unit 10, lit by the driving power from the power unit 10, and connected to each other in series, and a constant-current circuit unit 30 connected between the LED unit 20 and a ground to maintain a constant current flowing through the LED unit 20.

The constant-current circuit unit 30 includes a MOS transistor MOS including a drain connected to the cathode of the plurality of serially connected LEDs of the LED unit 20, a gate and a source, a sensing resistor RS connected between the source of the MOS transistor MOS and the ground, and a comparator 31 comparing a detection voltage VD detected by the sensing resistor RS with a predetermined reference voltage Vref to supply a tuning voltage VT determined by a difference between the two voltages to the gate of the MOS transistor MOS.

In the related art apparatus for driving the LED of FIG. 1 having the above construction, a current flowing through the LED unit 20 can be maintained constant using the constant-current circuit unit 30 supplying a constant current to the LED unit 20.

At this point, a current ILED flowing through the LED unit 20 is determined by the reference voltage Vref of the comparator 31 and the sensing resistor RS between the MOS transistor MOS and the ground as expressed by Equation 1.

$$ILED = \frac{Vref}{RS}. \qquad \text{Equation 1}$$

However, in the related art apparatus for driving the LED of FIG. 1, as the driving voltage Vcc increases, a drain-source voltage Vds of the MOS transistor MOS increases. When the drain-source voltage Vds increases, heat is generated from the MOS transistor MOS.

Also, in the case where the LED included in the LED unit 20 is a high power LED, a current flowing through the LED unit 20 increases even more and thus heat generation becomes serious.

SUMMARY OF THE INVENTION

An aspect of the present invention provides an apparatus for driving a light emitting element that can limit heat generation from a constant-current circuit including a MOS transistor by limiting a voltage applied to the constant-current circuit required for supplying a constant current to the light emitting element below a predetermined voltage.

According to an aspect of the present invention, there is provided an apparatus for driving a light emitting element, the apparatus including: a power unit supplying driving power; a light emitting element array including a plurality of light emitting elements connected in series between an anode terminal connected to the power unit and a cathode terminal; a constant-current circuit unit maintaining a constant current flowing through the light emitting element array according to a first tuning voltage; and a voltage limiting circuit unit connected between the cathode terminal of the light emitting element array and the constant-current circuit unit, and dividing a total voltage applied between the cathode terminal of the light emitting element array and a ground according to a second tuning voltage to limit a voltage applied to the constant-current circuit unit below a predetermined voltage.

According to another aspect of the present invention, there is provided an apparatus for driving a light emitting element, the apparatus including: a power unit supplying driving power; a light emitting element array including a plurality of light emitting elements connected in series between an anode terminal connected to the power unit and a cathode terminal; a constant-current circuit unit maintaining a constant current flowing through the light emitting element array according to a first tuning voltage; a voltage limiting circuit unit connected between the cathode terminal of the light emitting element array and the constant-current circuit unit, and dividing a total voltage applied between the cathode terminal of the light emitting element array and a ground according to a second tuning voltage to limit a voltage applied to the constant-current circuit unit; and a voltage division controller detecting a first voltage applied to the constant-current circuit unit and supplying the second tuning voltage to the voltage limiting circuit unit according to a magnitude of the first voltage to control a magnitude of a divided voltage applied to the voltage limiting circuit unit.

According to still another aspect of the present invention, there is provided an apparatus for driving a light emitting element, the apparatus including: a power unit supplying driving power generated using pulse width modulation (PWM); a light emitting element array including a plurality of light emitting elements connected in series between an anode terminal connected to the power unit and a cathode terminal; a constant-current circuit unit maintaining a constant current flowing through the light emitting element array according to a first tuning voltage; a voltage limiting circuit unit connected between the cathode terminal of the light emitting element array and the constant-current circuit unit, and dividing a total voltage applied between the cathode terminal of the light emitting element array and a ground according to a second tuning voltage to limit a voltage applied to the constant-current circuit unit; a voltage division controller detecting a first voltage applied to the constant-current circuit unit and supplying the second tuning voltage to the voltage limiting circuit unit according to a magnitude of the first voltage to control a magnitude of a divided voltage applied to the voltage limiting circuit unit; and a PWM switching controller switching on/off an output terminal of the constant-current circuit unit and an input terminal of the voltage division controller in synchronization with the driving power generated using the PWM.

The constant-current circuit unit may include a first metal oxide semiconductor (MOS) transistor including a drain connected to a current output terminal of the voltage limiting circuit unit, and a gate and a source; a sensing resistor connected between the source of the first MOS transistor and the ground, and sensing a current flowing through the first MOS transistor to output a first detection voltage; and a comparator comparing the first detection voltage with a predetermined first reference voltage and supplying the first tuning voltage to the gate of the first MOS transistor according to a difference between the two voltages to maintain a constant current flowing through the light emitting element array.

The PWM switching controller may include a first switch connected between the comparator of the constant-current circuit unit and the first MOS transistor; a second switch connected to a first voltage detection line of the voltage division controller; and a PWM controller switching on/off the first switch and the second switch in synchronization with the driving power generated using PWM.

The voltage limiting circuit unit may include a second MOS transistor including a drain connected to a cathode terminal of the light emitting element array, a source connected to the drain of the first MOS transistor, and a gate connected to a second tuning voltage terminal.

The voltage limiting circuit unit may include: a second MOS transistor including a drain connected to a cathode terminal of the light emitting element array, a source connected to the drain of the first MOS transistor, and a gate connected to a second tuning voltage terminal; and a voltage dividing resistor connected between the drain and the source of the second MOS transistor.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
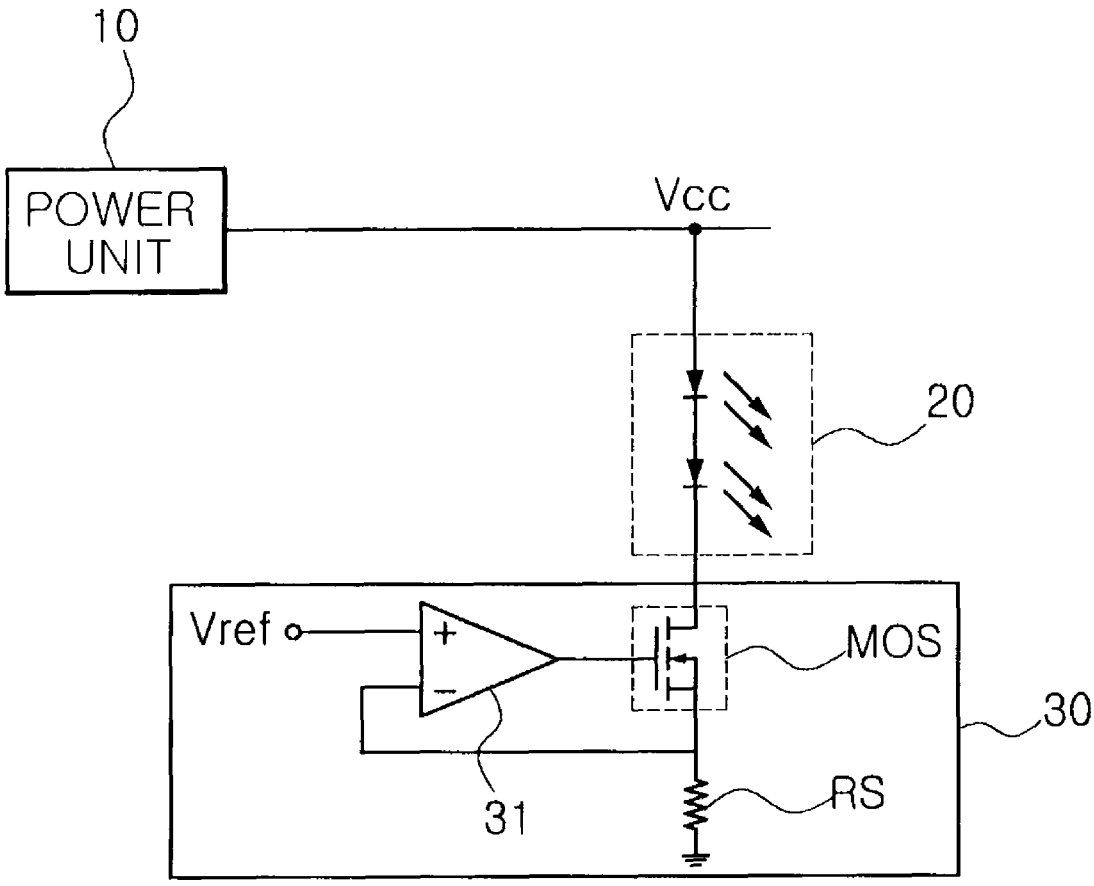
PRIOR ART FIG. 1
FIG. 1 is a view illustrating the construction of a related art apparatus for driving an LED.

Exemplary embodiments of the present invention will now be described in detail with reference to the accompanying drawings.

The present invention is not limited to embodiments set forth therein and the embodiments are provided to help understanding of the spirit of the present invention. In the drawings, same reference numerals are used for the same elements.

Figure 2:
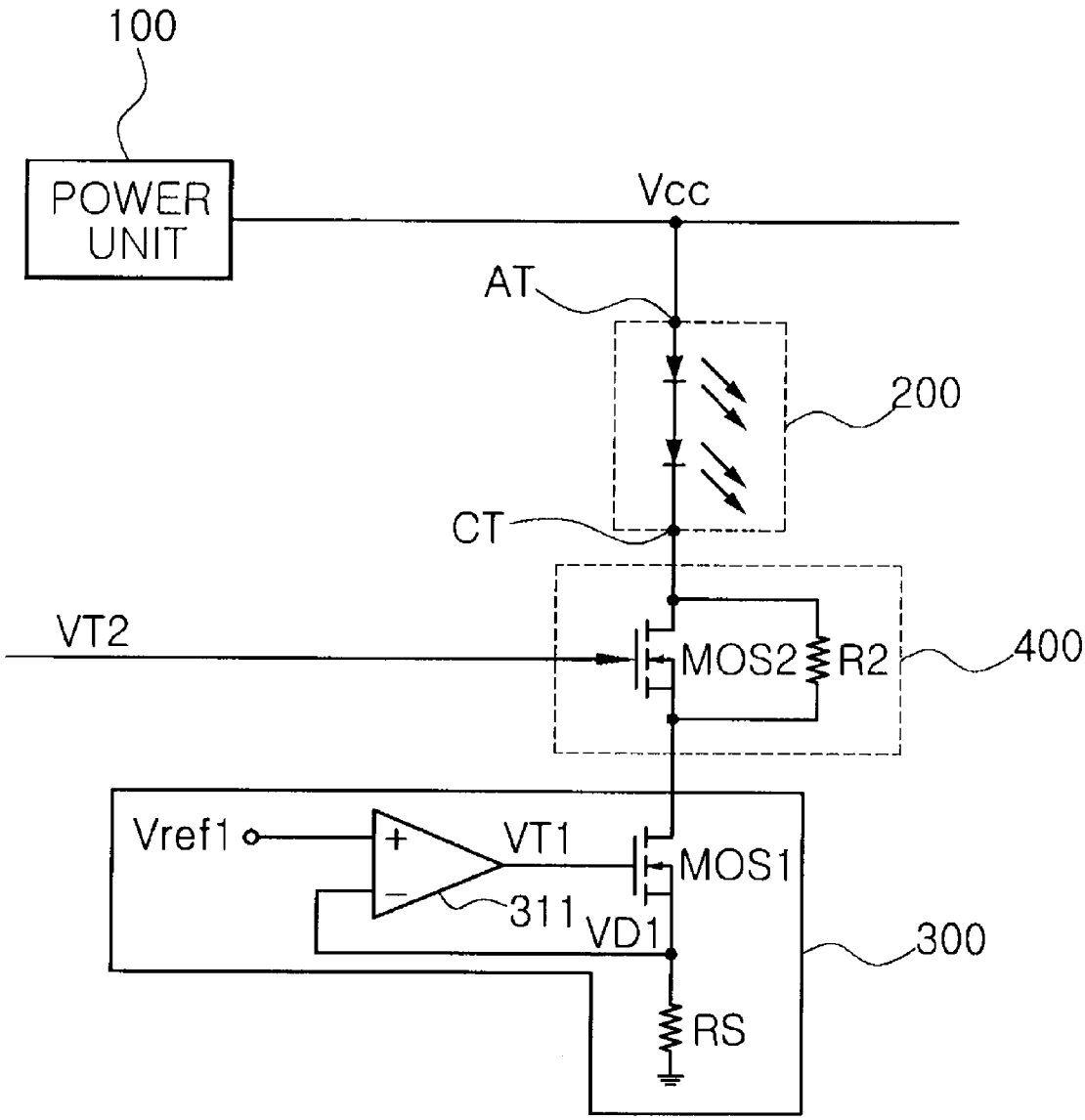
FIG. 2 is a view illustrating the construction of a first embodiment of an apparatus for driving a light emitting element according to the present invention.

FIG. 2 is a view illustrating a first embodiment of an apparatus for driving a light emitting element according to the present invention.

Referring to FIG. 2, the apparatus for driving the light emitting element includes: a power unit 100 supplying driving power Vcc, a light emitting element array 200 connected in series between an anode terminal AT connected to the power unit 100 and a cathode terminal CT, a constant-current circuit unit 300 maintaining a constant current flowing through the light emitting element array 200 according to a first tuning voltage VT1, and a voltage limiting circuit unit 400 connected between the cathode terminal CT of the light emitting element array 200 and the constant-current circuit unit 300, and dividing a total voltage applied between the cathode terminal CT of the light emitting element array 200 and a ground to limit a voltage applied to the constant-current circuit unit 300 below a predetermined voltage.

Figure 3:
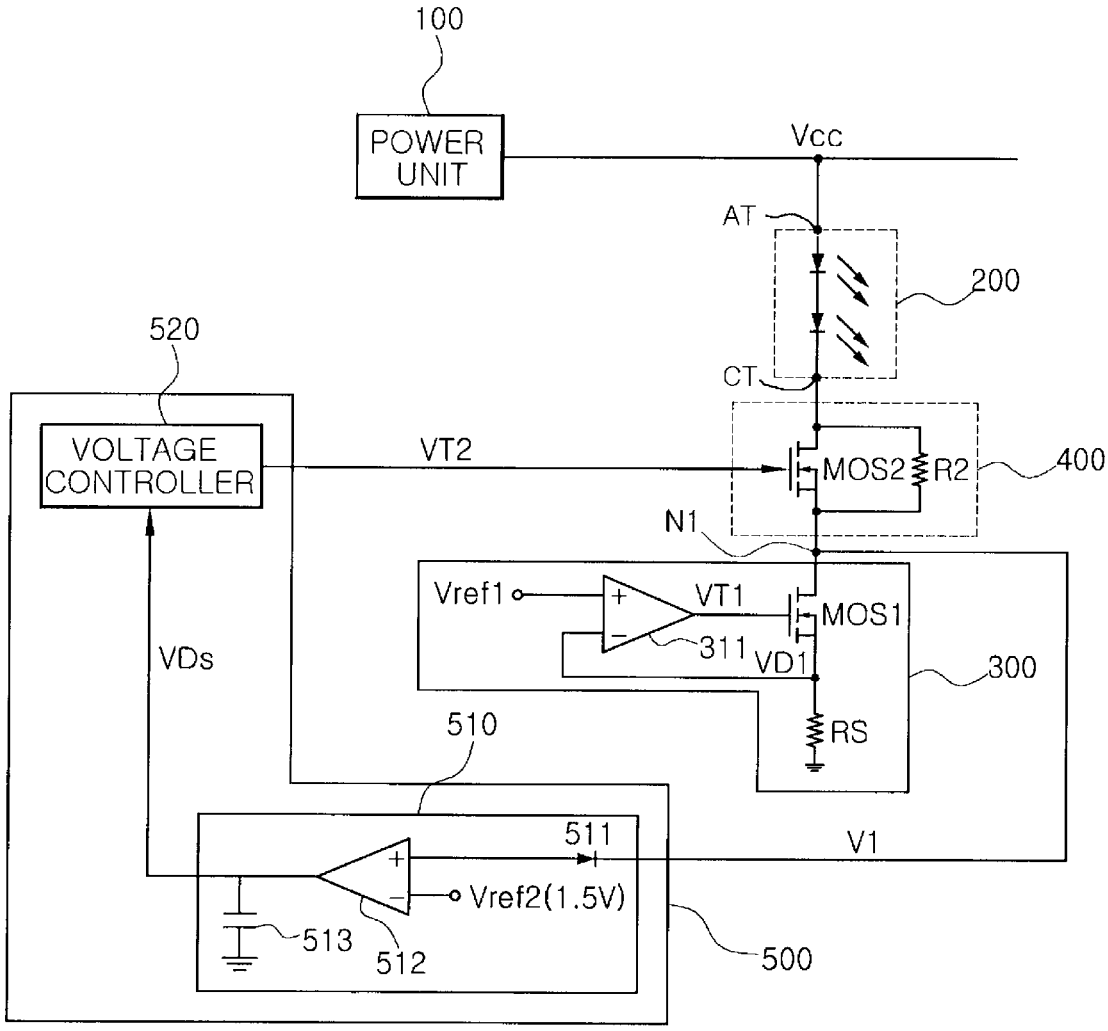
FIG. 3 is a view illustrating the construction of a second embodiment of an apparatus for driving a light emitting element according to the present invention.

FIG. 3 is a view illustrating the construction of a second embodiment of an apparatus for driving a light emitting element according to the present invention.

Referring to FIG. 3, the apparatus for driving the light emitting element includes: a power unit 100 supplying driving power Vcc, a light emitting element array 200 connected in series between an anode terminal AT connected to the power unit 100 and a cathode terminal CT, a constant-current circuit unit 300 maintaining a constant current flowing through the light emitting element array 200 according to a first tuning voltage VT1, a voltage limiting circuit unit 400 connected between the cathode terminal CT of the light emitting element array 200 and the constant-current circuit unit 300, and dividing a total voltage applied between the cathode terminal CT of the light emitting element array 200 and a ground according to a second tuning voltage VT2 to limit a voltage applied to the constant-current circuit unit 300, and a voltage division controller 500 detecting a first voltage V1 applied to the constant-current circuit unit 300 and supplying the second tuning voltage VT2 to the voltage limiting circuit unit according to a magnitude of the first voltage V1 to control a magnitude of a voltage applied to the voltage limiting circuit unit 400.

Figure 4:
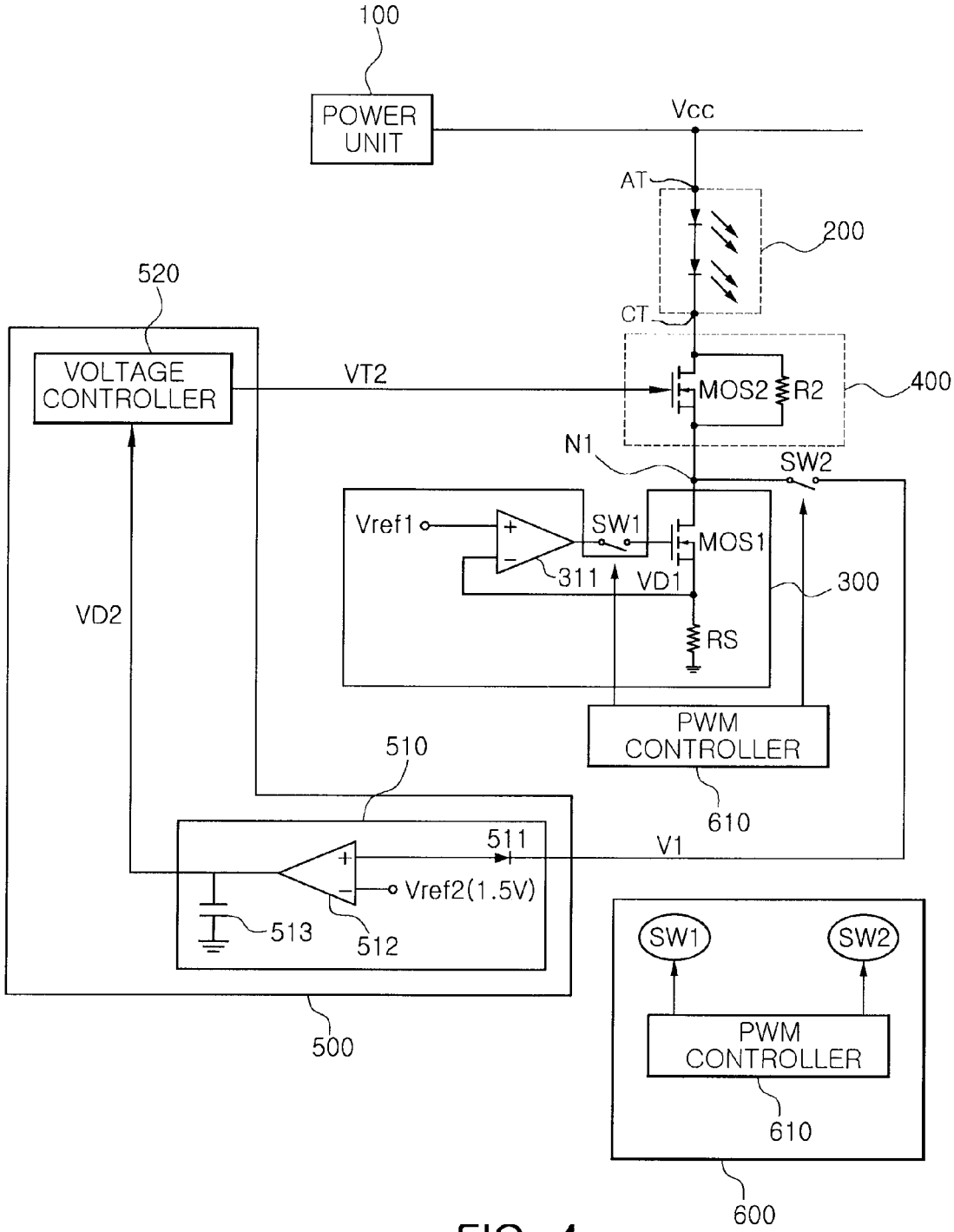
FIG. 4 is a view illustrating the construction of a third embodiment of an apparatus for driving a light emitting element according to the present invention.

FIG. 4 is a view illustrating the construction of a third embodiment of an apparatus for driving a light emitting element according to the present invention.

The apparatus for driving the light emitting element includes: a power unit 100 supplying driving power Vcc generated using a pulse width modulation (PWM), a light emitting element array 200 connected in series between an anode terminal AT connected to the power unit 100 and a cathode terminal CT, a constant-current circuit unit 300 maintaining a constant current flowing through the light emitting element array 200 according to a first tuning voltage VT1, a voltage limiting circuit unit 400 connected between the cathode terminal CT of the light emitting element array 200 and the constant-current circuit unit 300, and dividing a total voltage applied between the cathode terminal CT of the light emitting element array 200 and a ground according to a second tuning voltage VT2 to limit a voltage applied to the constant-current circuit unit 300, a voltage division controller 500 detecting a first voltage V1 applied to the constant-current circuit unit 300 and supplying the second tuning voltage VT2 to the voltage limiting circuit unit according to a magnitude of the first voltage V1 to control a magnitude of a divided voltage applied to the voltage limiting circuit unit 400, and a PWM switching controller 600 switching on/off an output terminal of the constant-current circuit unit 300 and an input terminal of the voltage division controller 500 in synchronization with the driving power Vcc generated using the PWM.

In each of the above-described embodiments of the present invention, the constant-current circuit unit 300 includes a first metal oxide semiconductor (MOS) transistor including a drain connected to a current output terminal of the voltage limiting circuit unit 400, and a gate and a source; a sensing resistor RS connected between the source of the first MOS transistor MOS1 and a ground, and sensing a current flowing through the first MOS transistor MOS1 to output a first detection voltage VD1; and a comparator 311 comparing the first detection voltage VD1 with a predetermined first reference voltage Vref1 and supplying the first tuning voltage VT to the gate of the first MOS transistor MOS1 according to a difference between the two voltages to maintain a constant current flowing through the light emitting element array 200.

Meanwhile, in still another embodiment, the PWM switching controller 600 includes a first switch SW1 connected between the comparator 311 of the constant-current circuit unit 300 and the first MOS transistor MOS1; a second switch SW2 connected to a first voltage detection line of the voltage division controller 500; and a PWM controller 610 switching on/off the first switch SW1 and the second switch SW2 in synchronization with the driving power Vcc generated using PWM.

The apparatus for driving the light emitting element according to the present invention can be applied to a plurality of light emitting element arrays connected to each other in parallel. For example, in the case where voltage limiting circuit units and constant-current circuit units connected to the plurality of light emitting element arrays are provided, a relevant voltage limiting circuit unit can be controlled according to a voltage applied to each of the constant-current circuit units.

Hereinafter, the voltage limiting circuit unit 400 applied to all of the above-described embodiments of the present invention is described.

Figure 5:
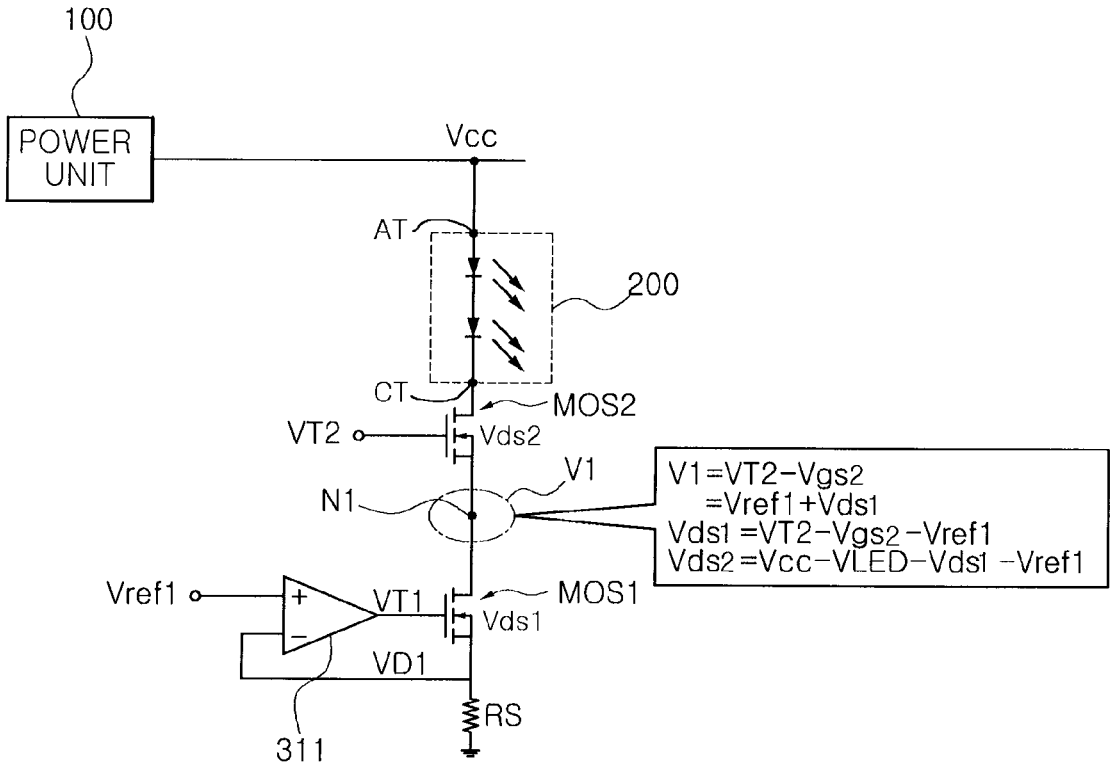
FIG. 5 is a view explaining voltage compensation by a voltage limiting circuit unit according to the present invention.

FIG. 5 is a view explaining voltage compensation by a voltage limiting circuit unit according to the present invention.

Referring to FIGS. 2 through 5, the voltage limiting circuit unit 400 can include a second MOS transistor MOS2 including a drain connected to the cathode terminal CT of the light emitting element array 200, a source connected to the drain of the first MOS transistor MOS1, and a gate connected to a terminal of a second tuning voltage VT2.

Figure 6:
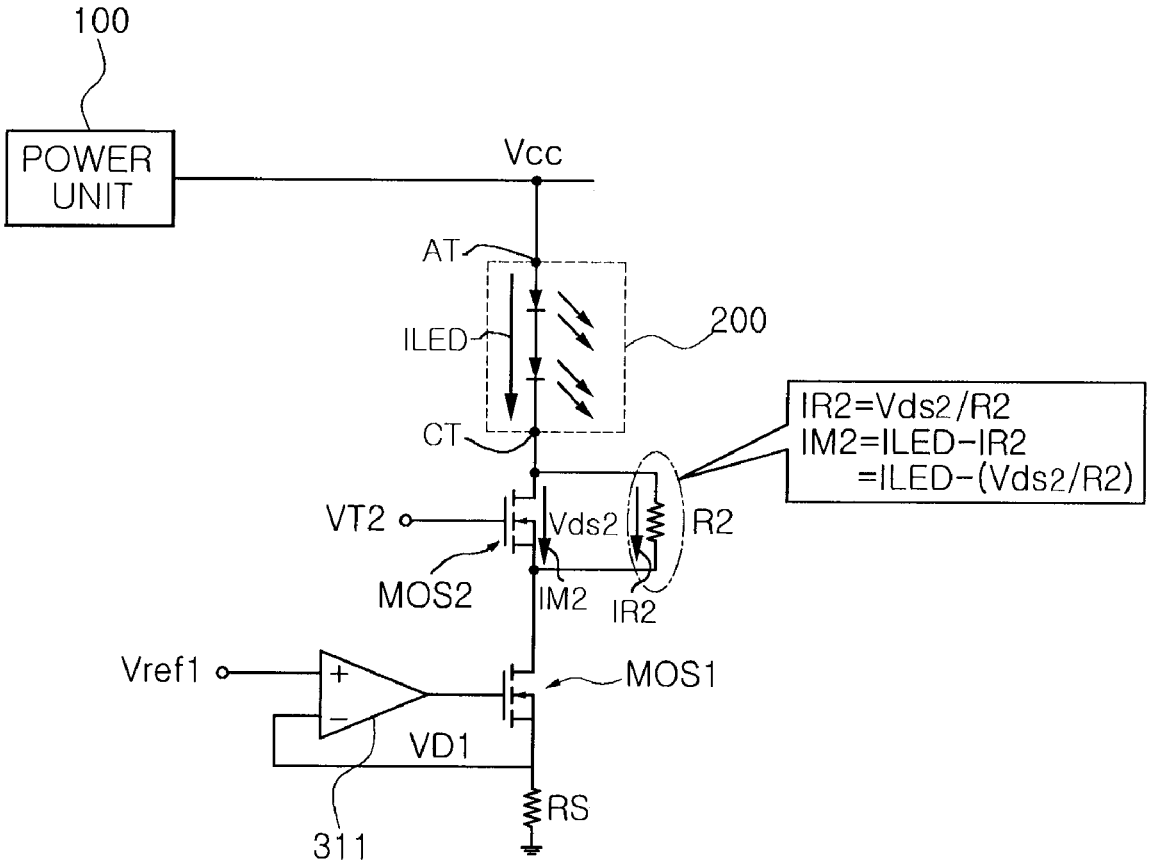
FIG. 6 is a view explaining a voltage dividing resistor of a voltage limiting circuit unit according to the present invention.

FIG. 6 is a view explaining a voltage dividing resistor of a voltage limiting circuit unit according to the present invention.

Referring to FIGS. 3 through 6, the voltage limiting circuit unit 400 includes a second MOS transistor MOS2 including a drain connected to the cathode terminal CT of the light emitting element array 200, a source connected to the drain of the first MOS transistor MOS1, and a gate connected to a terminal of a second tuning voltage VT2, and the voltage dividing resistor R2 connected between the drain and the source of the MOS transistor MOS2.

Hereinafter, an operation and an effect of the embodiments of the apparatus for driving a light emitting element according to the present invention is described with reference to FIGS. 2 through 6.

The embodiment illustrated in FIG. 2 is described. The apparatus for driving the light emitting element includes the power unit 100, the light emitting element array 200, the constant-current circuit unit 300, and the voltage limiting circuit unit 400.

The power unit 100 supplies the driving power Vcc required by the light emitting element array 200.

The light emitting element array 200 includes the plurality of light emitting elements connected in series between the anode terminal AT connected to the power unit 100 and the cathode terminal CT.

Here, the plurality of light emitting elements can be light emitting diodes (LEDs), laser diodes (LDs), or organic light emitting diodes (OLEDs).

The constant-current circuit unit 300 maintains a constant current flowing through the light emitting element array 200 according to the first tuning voltage VT1.

At this point, the voltage limiting circuit unit 400 is connected between the cathode terminal CT of the light emitting element array 200 and the constant-current circuit unit 300 and divides a total voltage applied between the cathode terminal CT of the light emitting element array 200 and the ground according to the second tuning voltage VT2 to limit a voltage applied to the constant-current circuit unit 300 below the predetermined voltage.

In detail, the voltage limiting circuit unit 400 is described with reference to FIG. 5. In the case where the voltage limiting circuit unit 400 includes the second MOS transistor MOS2 including a drain connected to the cathode terminal CT of the light emitting element array 200, a source connected to the drain of the first MOS transistor MOS1, and a gate connected to a terminal of a second tuning voltage VT2, a voltage applied to the constant-current circuit unit 300 can be controlled using the magnitude of the second tuning voltage VT2 supplied to the gate of the second MOS transistor MOS2.

At this point, a first voltage V1 at a connection node N1 between the first MOS transistor MOS1 and the second MOS transistor MOS2, and the drain-source voltages Vds1 and Vds2 of the first and second MOS transistors MOS1 and MOS2 are given by Equation 2 below $$\begin{aligned} V1 &= VT2 - Vgs2 \\ &= Vref1 + Vds1 \\ Vds1 &= VT2 - Vgs2 - Vref1 \\ Vds2 &= Vcc - VLED - Vds1 - Vref1. \end{aligned} \qquad \text{Equation 2}$$

Referring to Equation 2, when a low second tuning voltage VT2 is supplied, a low first voltage V1 can be generated. When the first voltage V1 is low, the drain-source voltage Vds1 of the first MOS transistor MOS1 becomes low, so that heat generation at the first MOS transistor MOS1 can be reduced by controlling the second tuning voltage VT2.

As described above, the heat generation of the first MOS transistor MOS1 can be solved by adding the second MOS transistor but the heat generation of the added second MOS transistor MOS2 itself may be generated. In this case, the heat generation of the second MOS transistor MOS2 is solved by adding a drain-source resistor of the second MOS transistor MOS2 as illustrated in FIG. 6.

Referring to FIG. 6, in the case where the voltage limiting circuit unit 400 further includes the voltage dividing resistor R2 connected between the drain and the source of the second MOS transistor MOS2, a current flowing through the second MOS transistor MOS2 is divided, so that heat generated from the second MOS transistor MOS2 can be distributed.

At this point, since a current IR2 flowing through the voltage dividing resistor R2 branches from a current ILED flowing through the light emitting element array 200, a current IM2 flowing through the second MOS transistor MOS2 reduces as expressed by Equation 3 below.

$$IR2 = Vds2 / R2 \qquad \text{Equation 3}$$

$$\begin{aligned} IM2 &= ILED - IR2 \\ &= ILED - (Vds2 / R2) \end{aligned}$$

That is, as expressed by Equation 3, the current flowing through the second MOS transistor MOS2 is divided by the voltage dividing resistor R2, so that the current flowing through the second MOS transistor MOS2 reduces and thus the heat generation of the second MOS transistor MOS2 can be solved.

Since the description of the embodiment illustrated in FIG. 2 according to the present invention is directly applied to each of the other embodiments, descriptions of the same parts are omitted.

Next, the embodiment illustrated in FIG. 3 is described. The apparatus for driving the light emitting element according to the present invention adds the voltage division controller 500 to the construction of the embodiment illustrated in FIG. 2.

At this point, the voltage division controller 500 detects the first voltage V1 applied to the constant-current circuit unit 300, and supplies the second tuning voltage VT2 to the voltage limiting circuit unit 400 according to the magnitude of the first voltage V1 to control the magnitude of a divided voltage applied to the voltage limiting circuit unit 400.

That is, the voltage division controller 500 can control the magnitude of the second tuning voltage VT2 according to the magnitude of the first voltage V1 applied to the constant-current circuit unit 300 to control the magnitude of the divided voltage applied to the voltage limiting circuit unit 400, and thus automatically limit the first voltage V1 applied to the constant-current circuit unit 300 below the predetermined voltage using a feedback control principle.

At this point, the predetermined voltage corresponds to a voltage obtained by subtracting the voltage applied to the voltage division controller 500 from a total voltage between the voltage division controller 500 to the ground.

Still another embodiment of the present invention illustrated in FIG. 4 is described. The apparatus for driving a light emitting element according to the embodiment of FIG. 4 adds the PWM switching controller 600 to the construction of the embodiment illustrated in FIG. 3.

At this point, the PWM switching controller 600 switches on/off the output terminal of the constant-current circuit unit 300 and the input terminal of the voltage division controller 500 in synchronization with the driving power Vcc generated using the PWM.

That is, a PWM controller 610 of the PWM switching controller 600 switches on or off a first switch SW1 connected to the output terminal of the constant-current circuit unit 300 and a second switch SW2 connected to the input terminal of the voltage division controller 500 in synchronization with the driving power Vcc generated using the PWM to switch on the first and second switches SW1 and SW2 during an on-section of a PWM control section, and switch off the first and second switches SW1 and SW2 during an off-section of the PWM control section.

The constant-current circuit unit 300 applied to the previous embodiments is described in detail.

The constant-current circuit unit 300 includes the first MOS transistor MOS1 including a drain connected to the current output terminal of the voltage limiting circuit unit 400, a gate connected to a terminal of the first tuning voltage VT1, and a source connected to the sensing resistor RS. At this point, the sensing resistor RS senses a current flowing through the first MOS transistor MOS1 to the ground to output the first detection voltage VD1 to the comparator 311.

The comparator 311 compares the first detection voltage VD1 with the predetermined first reference voltage Vref1 and supplies the first tuning voltage VT to the gate of the first MOS transistor MOS1 according to a difference between the two voltages to maintain a constant current flowing through the light emitting element array 200.

Also, the PWM switching controller 600 in the embodiment of FIG. 4 is described. The PWM controller 610 of the PWM switching controller 600 switches on or off the first switch SW1 and the second switch SW2 in synchronization with the driving power Vcc generated using the PWM.

Accordingly, the first switch SW1 switches on or off between the output terminal of the comparator 311 of the constant-current circuit unit 300 and the gate of the first MOS transistor MOS1 to connect/disconnect the gate of the first MOS transistor MOS1 to/from the output terminal of the comparator 311.

Also, the second switch SW2 is switched on or off to connect or disconnect a first voltage detecting line of the voltage division controller 500.

As described above, the light emitting element is repeatedly turned on or off using a PWM operation to control the brightness of the light emitting element such as an LED. At this point, during an off-state, the drain-source voltage Vds2 of the second MOS transistor MOS2 may rapidly increase. When the rapidly increased drain-source voltage is fed back, a malfunction of generating a tuning voltage even during an off-section is generated. Therefore, when a feedback path is switched off as in the present invention, stability and accuracy in the operation improve even more.

According to the present invention, emission from a constant-current circuit including a MOS transistor can be limited by limiting a voltage applied to the constant-current circuit required for supplying a constant current to a light emitting element below a predetermined voltage, and accordingly, heat generation of a product by the light emitting element is solved, so that life an reliability of the product can be improved.

Also, when a feedback control method and a method of switching a feedback path in PWM are used, the gate voltage of a MOS transistor can be precisely controlled using a feedback loop.

While the present invention has been shown and described in connection with the exemplary embodiments, it will be apparent to those skilled in the art that modifications and variations can be made without departing from the spirit and scope of the invention as defined by the appended claims.

What is claimed is:

1. An apparatus for driving a light emitting element, the apparatus comprising:

a power unit supplying driving power;

a light emitting element array comprising a plurality of light emitting elements connected in series between an anode terminal connected to the power unit and a cathode terminal;

a constant-current circuit unit maintaining a constant current flowing through the light emitting element array according to a first tuning voltage; and a voltage limiting circuit unit connected between the cathode terminal of the light emitting element array and the constant-current circuit unit, and dividing a total voltage applied between the cathode terminal of the light emitting element array and a ground according to a second tuning voltage to limit a voltage applied to the constant-current circuit unit below a predetermined voltage.

2. The apparatus of claim 1, wherein the constant-current circuit unit comprises:

a first metal oxide semiconductor (MOS) transistor comprising a drain connected to a connection node between the voltage limiting circuit unit and the constant-current circuit unit, a gate connected to a first tuning voltage terminal, and a source;

a sensing resistor connected between the source of the first MOS transistor and the ground, and sensing a current flowing through the first MOS transistor to output a first detection voltage; and a comparator comparing the first detection voltage with a predetermined first reference voltage to supply the first tuning voltage to the first MOS transistor according to a difference between the first detection voltage and the first reference voltage, thereby maintaining the constant current flowing through the light emitting element array.

3. The apparatus of claim 2, wherein the voltage limiting circuit unit comprises a second MOS transistor comprising a drain connected to the cathode terminal of the light emitting element array, a source connected to the drain of the first MOS transistor, and a gate connected to a second tuning voltage terminal.

4. The apparatus of claim 2, wherein the voltage limiting circuit unit comprises:

a second MOS transistor comprising a drain connected to the cathode terminal of the light emitting element array, a source connected to the drain of the first MOS transistor, and a gate connected to a second tuning voltage terminal; and a voltage dividing resistor connected between the drain and the source of the second MOS transistor.

5. An apparatus for driving a light emitting element, the apparatus comprising:

a power unit supplying driving power;

a light emitting element array comprising a plurality of light emitting elements connected in series between an anode terminal connected to the power unit and a cathode terminal;

a constant-current circuit unit maintaining a constant current flowing through the light emitting element array according to a first tuning voltage;

a voltage limiting circuit unit connected between the cathode terminal of the light emitting element array and the constant-current circuit unit, and dividing a total voltage applied between the cathode terminal of the light emitting element array and a ground according to a second tuning voltage to limit a voltage applied to the constant-current circuit unit; and a voltage division controller detecting a first voltage applied to the constant-current circuit unit and supplying the second tuning voltage to the voltage limiting circuit unit according to a magnitude of the first voltage to control a magnitude of a divided voltage applied to the voltage limiting circuit unit.

6. The apparatus of claim 5, wherein the constant-current circuit unit comprises:

a first metal oxide semiconductor (MOS) transistor comprising a drain connected to a connection node between the voltage limiting circuit unit and the constant-current circuit unit, a gate connected to a first tuning voltage terminal, and a source;

a sensing resistor connected between the source of the first MOS transistor and the ground and sensing a current flowing through the first MOS transistor to output a first detection voltage; and a comparator comparing the first detection voltage with a predetermined first reference voltage to supply the first tuning voltage to the first MOS transistor according to a difference between the first detection voltage and the first reference voltage to maintain the constant current flowing through the light emitting element array.

7. The apparatus of claim 6, wherein the voltage limiting circuit unit comprises a second MOS transistor comprising a drain connected to the cathode terminal of the light emitting element array, a source connected to the drain of the first MOS transistor, and a gate connected to a second tuning voltage terminal.

8. The apparatus of claim 6, wherein the voltage limiting circuit unit comprises:

a second MOS transistor comprising a drain connected to the cathode terminal of the light emitting element array, a source connected to the drain of the first MOS transistor, and a gate connected to a second tuning voltage terminal; and a voltage dividing resistor connected between the drain and the source of the second MOS transistor.

9. An apparatus for driving a light emitting element, the apparatus comprising:

a power unit supplying driving power generated using pulse width modulation (PWM);

a light emitting element array including a plurality of light emitting elements connected in series between an anode terminal connected to the power unit and a cathode terminal;

a constant-current circuit unit maintaining a constant current flowing through the light emitting element array according to a first tuning voltage;

a voltage limiting circuit unit connected between the cathode terminal of the light emitting element array and the constant-current circuit unit, and dividing a total voltage applied between the cathode terminal of the light emitting element array and a ground according to a second tuning voltage to limit a voltage applied to the constant-current circuit unit;

a voltage division controller detecting a first voltage applied to the constant-current circuit unit and supplying the second tuning voltage to the voltage limiting circuit unit according to a magnitude of the first voltage to control a magnitude of a divided voltage applied to the voltage limiting circuit unit; and a PWM switching controller switching on/off an output terminal of the constant-current circuit unit and an input terminal of the voltage division controller in synchronization with the driving power generated using the PWM.

10. The apparatus of claim 9, wherein the constant-current circuit unit comprises:

a first MOS transistor comprising a drain connected to a current output terminal of the voltage limiting circuit unit, and a gate and a source;

a sensing resistor connected between the source of the first MOS transistor and the ground, and sensing a current flowing through the first MOS transistor to output a first detection voltage; and a comparator comparing the first detection voltage with a predetermined first reference voltage and supplying the first tuning voltage to the gate of the first MOS transistor according to a difference between the two voltages to maintain a constant current flowing through the light emitting element array.

11. The apparatus of claim 10, wherein the PWM switching controller comprises:

a first switch connected between the comparator of the constant-current circuit unit and the first MOS transistor;

a second switch connected to a first voltage detection line of the voltage division controller; and a PWM controller switching on/off the first switch and the second switch in synchronization with the driving power generated using PWM.

12. The apparatus of claim 11, wherein the voltage limiting circuit unit comprises a second MOS transistor comprising a drain connected to a cathode terminal of the light emitting element array, a source connected to the drain of the first MOS transistor, and a gate connected to a second tuning voltage terminal.

13. The apparatus of claim 11, wherein the voltage limiting circuit unit comprises:

a second MOS transistor including a drain connected to a cathode terminal of the light emitting element array, a source connected to the drain of the first MOS transistor, and a gate connected to a second tuning voltage terminal; and a voltage dividing resistor connected between the drain and the source of the second MOS transistor.

* * * * *